US010932566B1

(12) United States Patent
Waddey, Jr.

(10) Patent No.: US 10,932,566 B1
(45) Date of Patent: Mar. 2, 2021

(54) FIREWOOD STORAGE CONTAINER AND COVER

(71) Applicant: Ira C. Waddey, Jr., Nashville, TN (US)

(72) Inventor: Ira C. Waddey, Jr., Nashville, TN (US)

( * ) Notice: Subject to any disclaimer, the term of this patent is extended or adjusted under 35 U.S.C. 154(b) by 0 days.

(21) Appl. No.: 16/385,389

(22) Filed: Apr. 16, 2019

Related U.S. Application Data

(60) Provisional application No. 62/661,142, filed on Apr. 23, 2018.

(51) Int. Cl.
*E04H 1/12* (2006.01)
*A47B 81/00* (2006.01)
*A47B 91/02* (2006.01)

(52) U.S. Cl.
CPC ..... *A47B 81/007* (2013.01); *A47B 91/02* (2013.01); *E04H 1/1205* (2013.01)

(58) Field of Classification Search
CPC ..... A47B 81/007; A47B 91/02; E04H 1/1205
See application file for complete search history.

(56) References Cited

U.S. PATENT DOCUMENTS 2,012,803 A * 8/1935 Baker ..... A47B 81/007 312/263
2,731,972 A * 1/1956 Braun ..... B65D 55/063 135/125
3,021,011 A * 2/1962 Visneski ..... B62B 3/04 211/49.1
3,147,606 A * 9/1964 Holmberg ..... A47B 81/007 69/19
3,187,901 A * 6/1965 Wilson ..... F24B 15/00 211/49.1
3,210,091 A * 10/1965 Ng ..... A01G 20/30 280/47.35
3,233,618 A * 2/1966 Ferrier ..... A47B 85/06 108/42
3,441,037 A * 4/1969 Transeau ..... E04H 15/003 135/97

(Continued)

FOREIGN PATENT DOCUMENTS

EP 1614629 A1 * 1/2006 ..... F24B 15/00
FR 1376722 A * 10/1964 ..... A47B 81/007

*Primary Examiner* — Kimberley S Wright
(74) *Attorney, Agent, or Firm* — Waller Lansden Dortch & Davis, LLP; Christopher T. McNeill

(57) ABSTRACT

A firewood storage apparatus, the apparatus comprising a firewood rack and a firewood rack cover. The firewood rack may have vertical support members, a pitched member, and a firewood rack member. The firewood rack cover may comprise material which is fashioned to conform to the profile of the firewood rack. Each vertical support member having an upper end and a lower end, the pitched member having a pitched profile supported by the plurality of vertical support members, and a firewood support member having a receiving surface for supporting firewood. The firewood rack cover may have an outer, weather-proof coating and an inner cavity having an open end and a closed end, the inner cavity formed to receive the firewood rack, wherein the firewood rack cover has a weather-proof properties, and wherein the inner cavity closed end matches the pitched profile of the pitched member of the firewood rack.

20 Claims, 11 Drawing Sheets

(56) References Cited

U.S. PATENT DOCUMENTS 4,333,574 A * 6/1982 Christy, Sr. ..... E04H 1/1205 211/49.1
4,349,213 A * 9/1982 Hirsch ..... B62B 1/00 126/283
4,616,757 A * 10/1986 Hobson ..... B27B 17/0041 211/189
4,621,865 A * 11/1986 Herrera ..... A47B 83/02 297/158.3
4,865,066 A * 9/1989 Brooks ..... E04H 15/58 135/121
5,028,062 A * 7/1991 Pinnell ..... B62B 3/02 280/2
5,245,801 A * 9/1993 Boesvert ..... A47J 37/0786 312/249.9
5,383,313 A * 1/1995 Deeke ..... E04H 1/1205 49/366
5,385,247 A * 1/1995 Owens ..... E04H 1/1205 211/49.1
5,743,413 A * 4/1998 Noll ..... A47B 45/00 211/175
5,832,943 A * 11/1998 Johnson ..... E04H 15/36 135/124
6,290,073 B1 * 9/2001 Barnes, Sr. ..... F24B 15/00 211/175
7,152,733 B2 * 12/2006 Trickett ..... A47J 37/0786 206/320
8,528,754 B2 * 9/2013 Noniewicz ..... B27B 21/00 211/195
D713,520 S * 9/2014 Alexander ..... D23/410
8,973,767 B1 * 3/2015 Stearns ..... A47B 81/00 211/134
8,997,769 B2 * 4/2015 Carpenter ..... F02B 63/048 135/161
9,388,600 B2 * 7/2016 Leathers ..... A47B 97/00
2002/0179211 A1 * 12/2002 Neal ..... A47J 37/0786 150/154
2003/0121539 A1 * 7/2003 Gu ..... E04B 1/34357 135/97
2007/0068094 A1 * 3/2007 Fralish ..... E04H 1/1205 52/143
2011/0084577 A1 * 4/2011 Leatherman ..... A47B 47/04 312/100

* cited by examiner 10
26
22
24a
24b
24b
24b
24a
24a
24a
24b
24b
24b
24a
24a
24a
24b
24b
24b
24a
24a

FIREWOOD STORAGE CONTAINER AND COVER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application is a non-provisional of U.S. Patent Application No. 62/661,142 filed Apr. 23, 2018 entitled FIREWOOD STORAGE CONTAINER AND COVER, which is hereby incorporated by reference in its entireties.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to firewood storage containers and covers for storing firewood and protecting firewood from inclement weather which would render the firewood unusable.

Firewood is used for burning to heat homes, provide fuel for outdoor fires in a fire ring, and for campfires. Because the firewood is only effective as fuel when it has been sufficiently dried by removing the moisture from the fibers of the wood which allows the firewood to freely burn. Firewood is often allowed to sit for long periods of time in order for the moisture to be removed from the fibers. Firewood is generally large and takes a substantial amount of room when storing the firewood. Because of this, firewood is often stored outdoors to dry.

After the firewood has dried and is ready for use, it is often delivered to the site at which it will be burned or stored. Often, firewood is obtained in bulk because it is more cost-effective and less burdensome to make repeated trips or deliveries for the firewood. Because large quantities of firewood are generally obtained at a given time and then the firewood is slowly used as fuel, it follows that a large amount of firewood will be stored. Because outdoor space is preferable for storage of firewood due to space constraints and sanitary concerns, firewood is often stored outdoors.

In climates where moisture is a common occurrence for outside spaces, firewood may become unusable after a rain. Due to humidity, the firewood might remain wet and unusable for long periods of time after rain falls. This can be especially problematic when these storms occur during the winter and individuals rely on the firewood for fuel to heat a home.

Many have attempted to solve this problem with various firewood stands and the likes. Often firewood stands only elevate firewood off of the ground or provide a certain degree of organization to the firewood. However, the firewood is still exposed to inclement weather from the top or from the sides. Others have provided full enclosures, however this is costly, takes up more space, is more expensive, and can harbor unwanted wildlife and critters.

What is needed then are effective and efficient apparatuses for storing and protecting firewood from inclement weather.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is a firewood storage apparatus, the apparatus comprising a firewood rack and a firewood rack cover. The firewood rack may comprise vertical support members, a pitched member, and a firewood rack member. The firewood rack cover may comprise material which is fashioned to conform to the profile of the firewood rack.

Another aspect of the disclosure includes a firewood storage apparatus, which may comprise a firewood rack having a plurality of vertical support members, each vertical support member having an upper end and a lower end, a pitched member having a pitched profile, having an upper surface and a lower surface, and supported by the plurality of vertical support members, wherein the upper end of each vertical support member is coupled to the lower surface of the pitched member, a firewood support member having a receiving surface for supporting firewood, a plurality of adjustable legs coupled to the lower end of each vertical support member, and a plurality of base plates coupled to the plurality of adjustable legs. The apparatus may also include a firewood rack cover having an outer, weather-proof coating and an inner cavity 120 having an open end 122 and a closed end 124, the inner cavity formed to receive the firewood rack 10, wherein the firewood rack cover 100 has a weather-proof properties, and wherein the inner cavity closed end 124 matches the pitched profile of the pitched member 20 of the firewood rack 10.

Another aspect of the disclosure includes a firewood rack cover that includes a slit or plurality of slits around the edges between lengthwise and depth wise panels. The panels may be temporarily displaced to gain access to the materials on the firewood rack.

Numerous other objects, advantages and features of the present disclosure will be readily apparent to those of skill in the art upon a review of the following drawings and description of a preferred embodiment.

DETAILED DESCRIPTION

Figure 1:
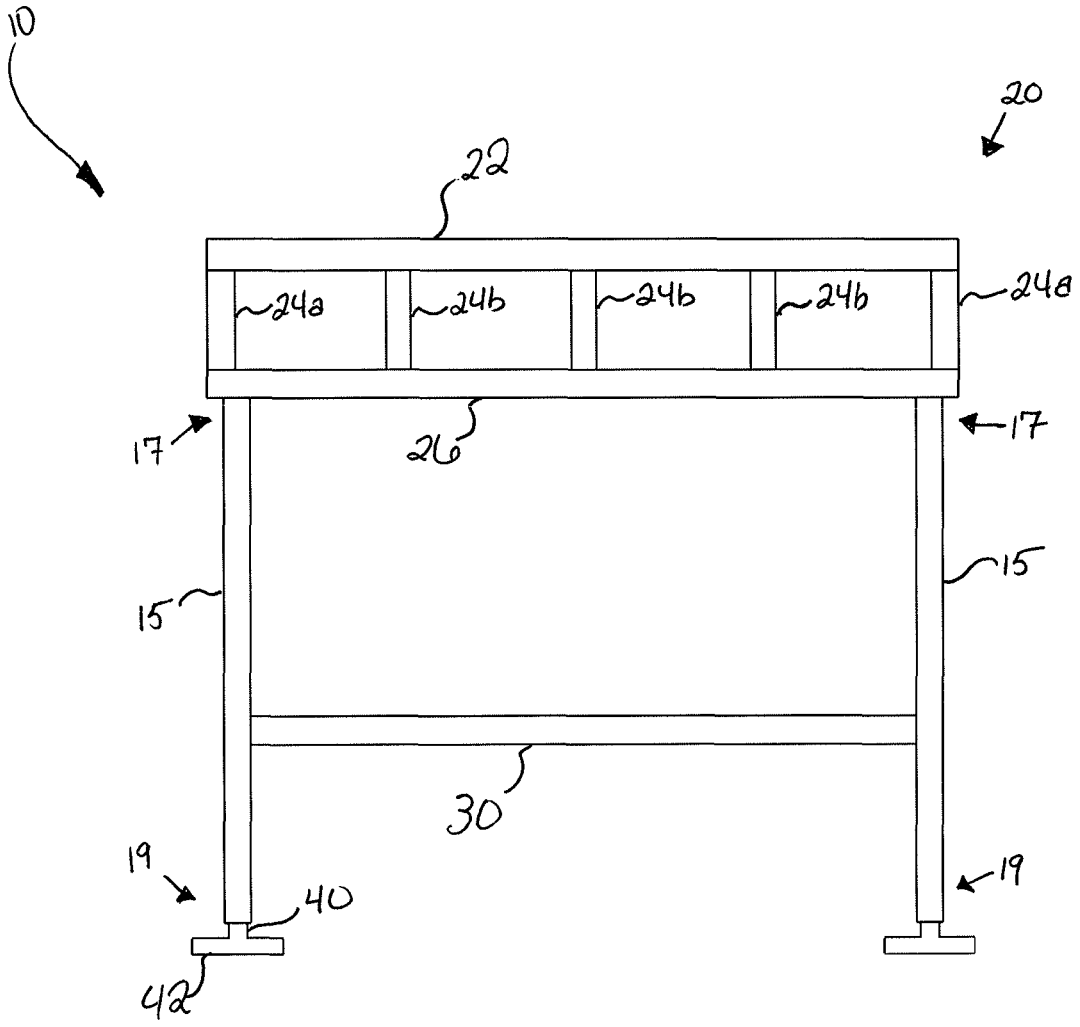
FIG. 1 is a front view of an exemplary embodiment of a firewood rack having a framed pitched member

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

A firewood storage apparatus generally comprises a firewood rack and a firewood covering. The firewood rack includes a plurality of vertical support members, a pitched member, a firewood support member, a plurality of adjustable legs, and a plurality of base plates. The firewood rack cover is formed to match the profile or outer dimensions of the firewood rack. The firewood rack cover may comprise a textile with inherent weatherproof properties or may include a coating with weatherproof properties.

Firewood Rack

Referring now to FIG. 1, a firewood rack 10 is provided, the firewood rack 10 having a plurality of vertical support members 15, each vertical support member 15 having an upper end 17 and lower end 19. The vertical support members 15 may be positioned such that the base forms a rectangle, each of the vertical support members 15 positioned at or near a corner of the rectangle. It is within the contemplation of this disclosure that the base may comprise any shape including triangular bases, polygonal bases, circular or elliptical bases, square bases, and any other shaped base which is readily apparent to one of ordinary skill in the art. Furthermore, the vertical support members 15 may be located at corners, along the periphery of the base, or even positioned within the area or field of the base, as would be readily apparent to one of skill in the art.

With further reference to FIG. 1, the plurality of vertical support members 15 are coupled to a pitched member 20 at the upper ends 17 of each of the vertical support members 15. The pitched member 20, as demonstrated in FIGS. 1, 3, and 5 may include framing-type members which provide a pitched profile for the pitched member 20. For example, the pitched member 20 may comprise assembled tubing. The tubing, when assembled, forms a pitched member 20. The tubing forms the pitched profile for the pitched member 20. The pitched profile of the pitched member 20 may comprise various materials, for example, metal tubing, PVC pipes, studs, rods, beams, or any other material readily recognizable by one of skill in the art for forming a pitched member.

Figure 5:
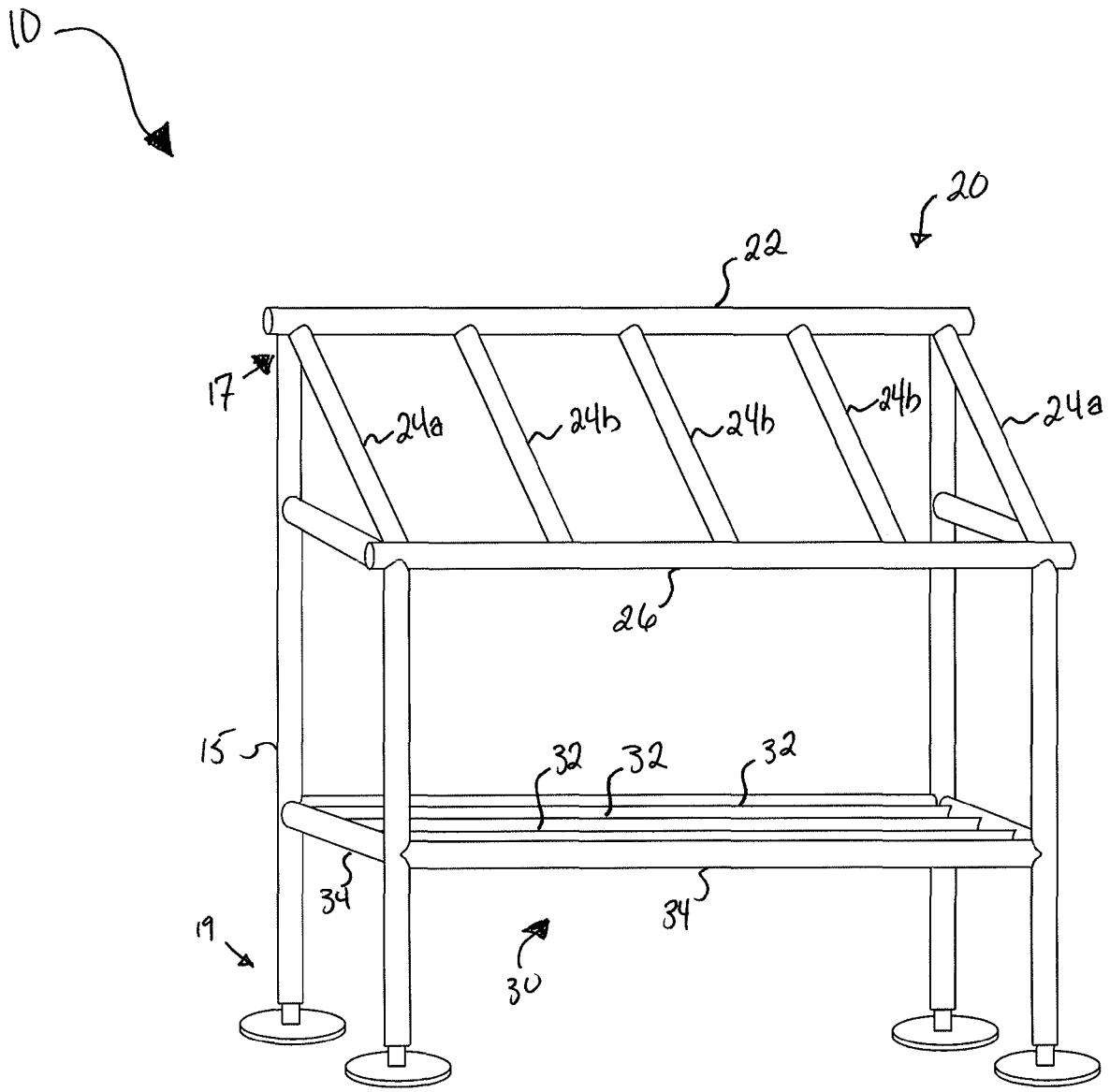
FIG. 5 is a perspective side view of an exemplary embodiment of a firewood rack having a framed pitched member with a shack profile.
Figure 6:
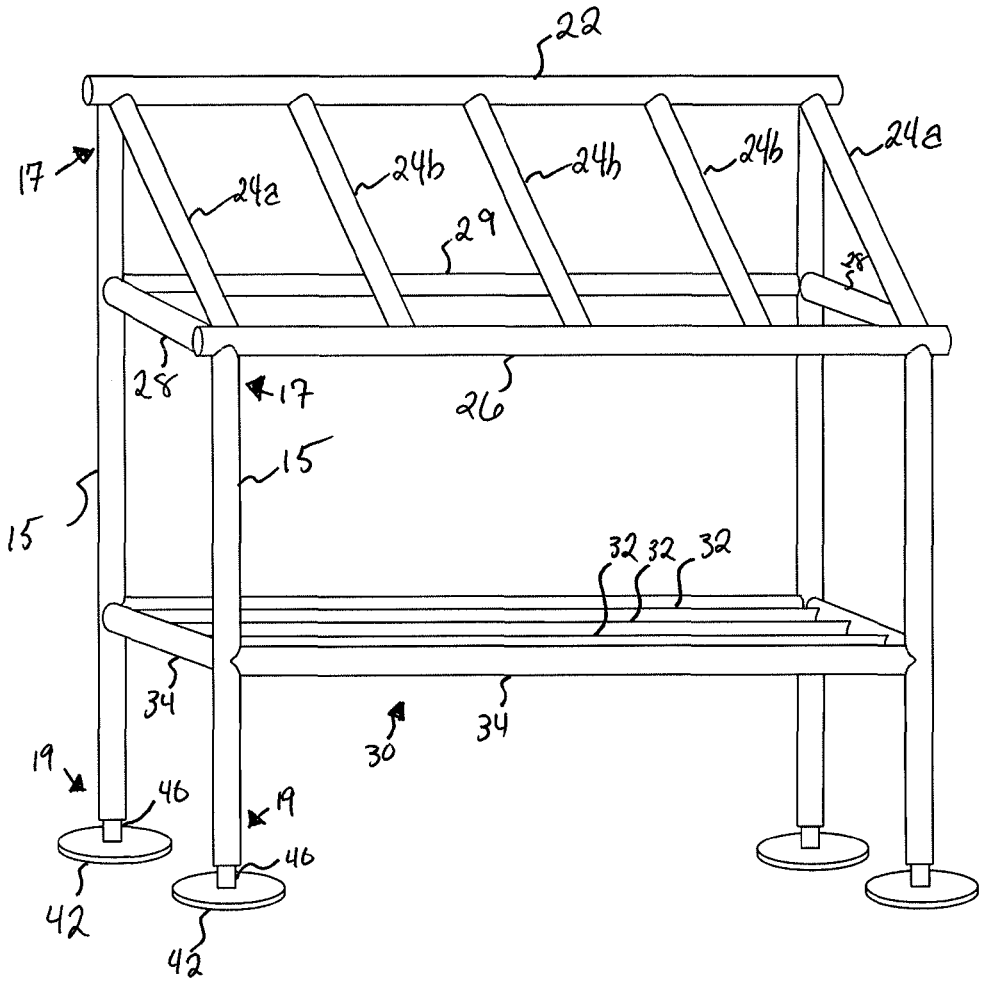
FIG. 6 is a perspective side view of an exemplary embodiment of a firewood rack having a framed pitched member with a shack profile and a back support bar.
Figure 7:
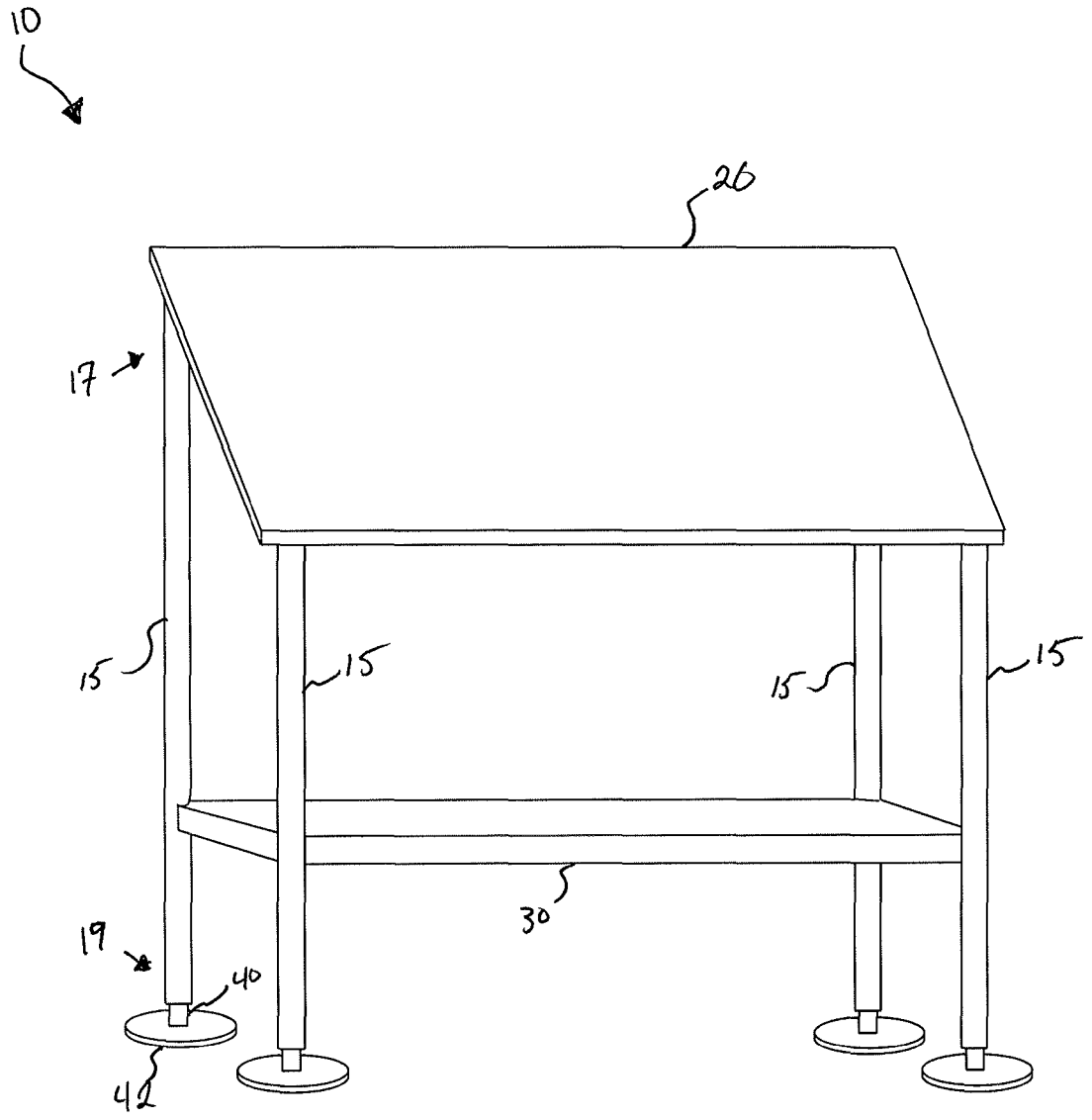
FIG. 7 is a perspective side view of an exemplary embodiment of a firewood rack having a solid pitched member with a shack profile.

The pitched member 20 may have a pitched profile of a variety of different shapes and forms. For example, the pitched profile of the pitched member of FIGS. 3 and 4 include that of an open gable. FIGS. 5, 6, and 7 represent a pitched profile similar to that of a shed. Other exemplary pitched profiles that may be implemented and are not shown in the drawings include hip, skillion, lean-to, box gable, hip, gambrel, mansard, butterfly, dutch gable, jerkinhead, hexagonal gazebo, saltbox, pyramid hip, and any other profile which is readily available to one of skill in the art.

Figure 3:
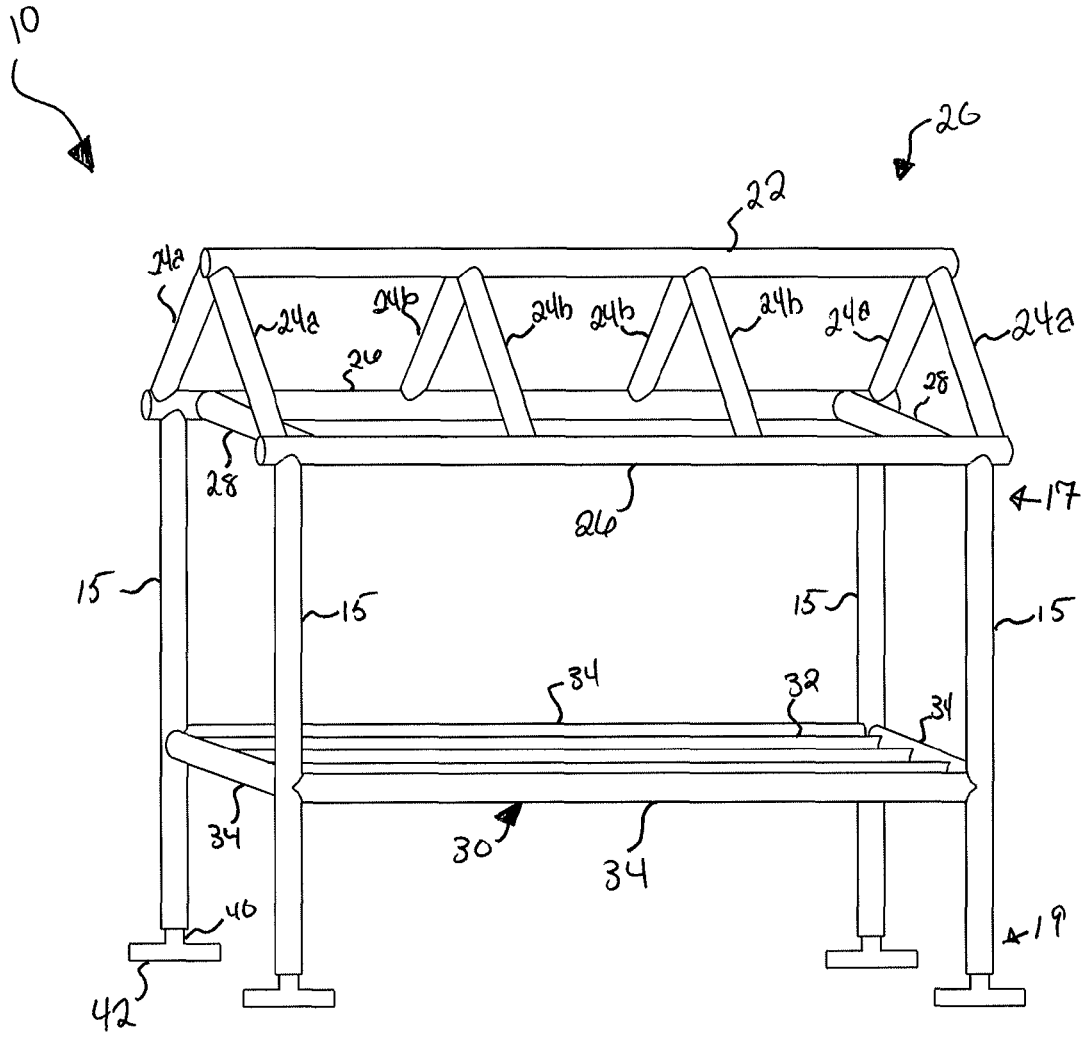
FIG. 3 is a perspective side view of an exemplary embodiment of a firewood rack having a framed pitched member with a gable profile.

As in FIG. 3, when an open gable profile is implemented, the pitched member 20 may include a ridge support member 22, rafters 24, and a top plate 26. In some embodiments the pitched member 20 may implement a main rafter 24*a* and a common rafter 24*b*. The ridge support member 22 is the central and highest point or peak of the pitched member 20 implementing an open gable profile. Rafters 24 extend from the ridge support member 22 perpendicular to the ridge support member 22. Each rafter 24 has a corresponding rafter that extends from the ridge support member 22 from the same or similar longitudinal position along the ridge support member 22. Both the rafter and the corresponding rafter extend perpendicularly from the ridge support member 22 such that the angle between the rafter and corresponding rafter is greater than zero degrees and less than 180 degrees. This relative angle between the rafter and the corresponding rafter are what form the basis for the pitched profile of the pitched member 20.

The main rafters 24*a* may be located near the longitudinal ends of the ridge support member 22. Common rafters 24*b* may be disposed along the ridge support member 22 between the main rafters 24*a*. Each of the rafters 24 may be coupled to a top plate 26. The top plate 26 is disposed parallel to the ridge support member 22 and coupled to the rafters 24 at an opposite end of the rafter 24 or alternatively is coupled to the rafters 24 at varying longitudinal points about the rafters 24. In some embodiments a joist 28 is coupled to a rafter and the corresponding rafter positioned across the ridge support member 22. A joist 28 may span the gap between the top plates 26 which are coupled to the respective rafters 24. The joist 28 provides stability and structural integrity to the pitched member 20 and to the firewood rack 10 generally.

Now referring to FIG. 5, where a shack profile is implemented for the pitched member 20, the ridge support member 20 is coupled to two of the vertical support members 15. The two vertical support members to which the ridge support member 22 is coupled is longer than the two remaining vertical support members. The top plate 26 spans a gap between the remaining vertical support members which are shorter. Thus the ridge support member 22 and the top plate 26 are coupled to the top ends 17 of the respective vertical support members 15. Rafters 24 are coupled to and span between the ridge support member 22 and the top plate 26. Thus, a first end of a rafter 24 is coupled to the ridge support member 22 while the second end of the rafter 24 is coupled to the top plate 26. Because the vertical support members 15 are of different lengths, the rafters 24 are pitched. The pitch or angle at which the rafters 24 are disposed is greater than zero degrees and less than 90 degrees relative to a horizontal axis. FIG. 6 includes a depiction of an embodiment with a back support bar 29. In any embodiment, a number of support bars may be implemented as known by one of skill in the art to strengthen the structural integrity of the firewood rack 10.

Figure 2:
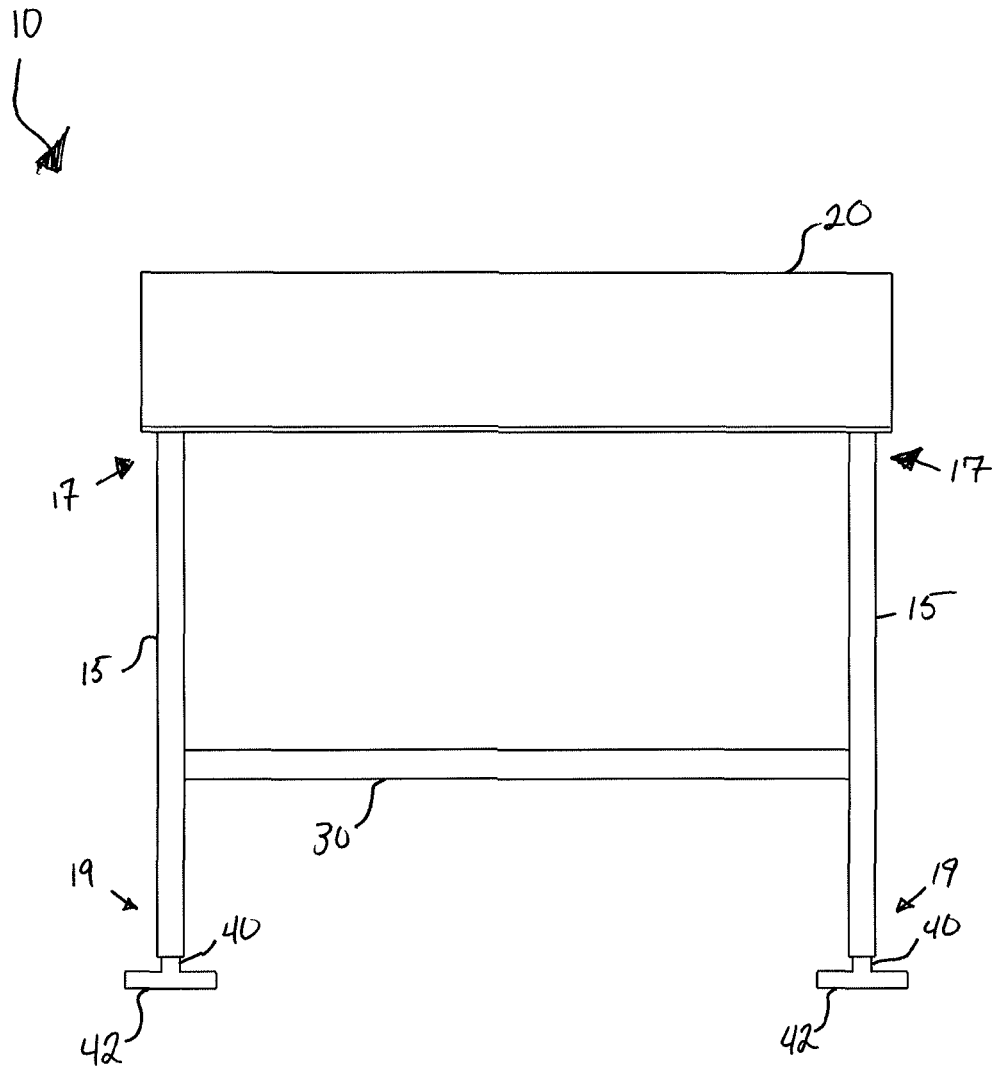
FIG. 2 is a front view of an exemplary embodiment of a firewood rack having a solid pitched member.
Figure 4:
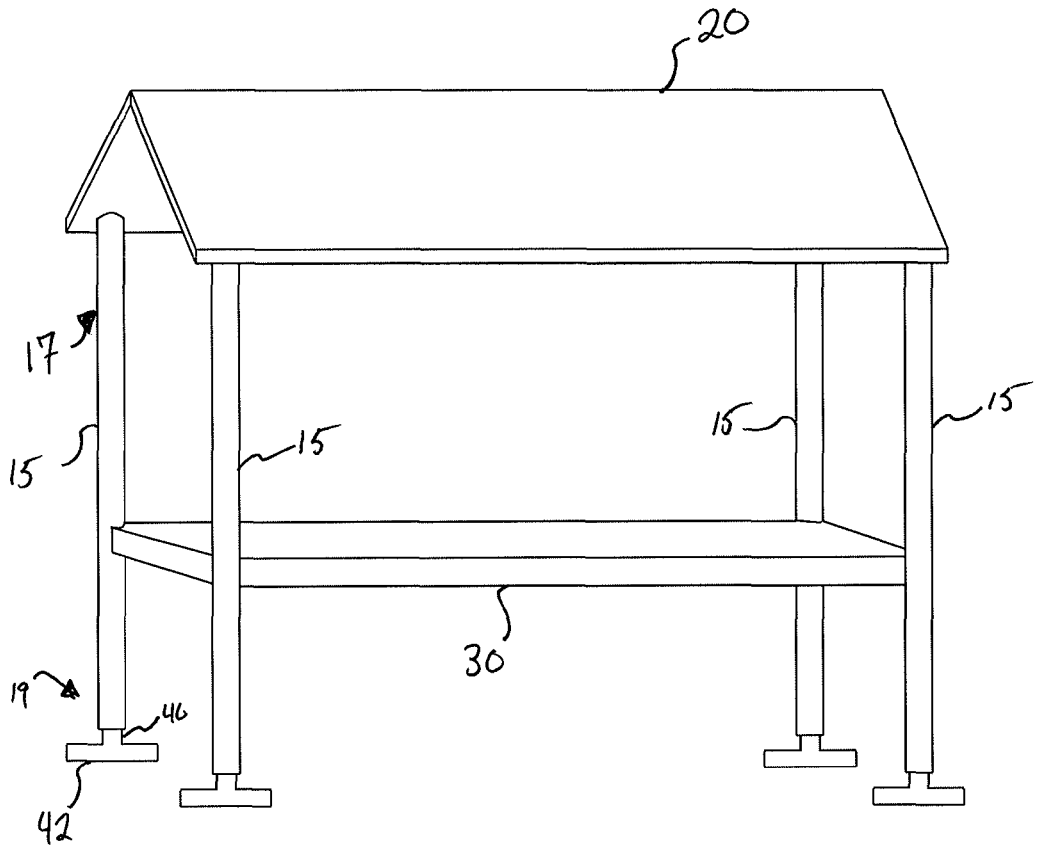
FIG. 4 is a perspective side view of an exemplary embodiment of a firewood rack having a solid pitched member with a gable profile.

Referring now to FIGS. 2, 4, and 7, the pitched member 20 may include a roof-like structures, including the layers and materials used in the construction and weather-proofing used in roof construction. For example, the pitched member may include a layered construction using all or a combination of the following: wood, particle board, felt underlayment, asphalt shingles, sealant, self-adhesive waterproof underlayment, flashing, staples, tar, and any other material readily available to one of skill in the art. The pitched member may implement a variety of roofing construction techniques and forms. The pitched member provides shelter from rain, snow, and debris, providing protection inclement weather, moisture, and other debris that will interfere with the effectiveness of the firewood as fuel or clutter the rack.

The firewood rack 10 further comprises a firewood support member 30. The firewood support member is coupled to each vertical support member 15. The firewood support member 30 may be positioned along the vertical support members 15 at a lateral position along the vertical support member 15. The firewood support member 30 may comprise a single surface upon which firewood may be placed, as demonstrated in FIG. 4. In other embodiments, the firewood support member 30 may comprise a rack or grill system. These embodiments allow for any moisture that might be received to fall away from the firewood. For example, FIG. 3 depicts a firewood rack 10 having a firewood support member 30, in which the firewood support member 30 comprises a plurality of rails 32 extending across a length of the firewood rack 10. Specifically, the firewood support member 30 comprises cross bars 34 coupled to the vertical support members 15 such that the cross bars 34 span the gap between the each of the vertical support members 15. The plurality of rails 32 are coupled to the cross bars 34 and span the length of the firewood rack 10. Alternatively, the plurality of racks 32 may span the depth of the firewood rack 10. The configuration may be altered in accordance with the type of material being stored on the firewood rack 10 and the dimensions of the material. Thus, pooling of water does not occur on the surface of the firewood support member 30.

In some embodiments, the firewood rack 10 may have a depth of approximately 24 inches. In other embodiments the firewood rack 10 may have a depth of approximately 36 inches, thus accommodating items with a longer dimension. In some embodiments, the firewood rack 10 is configured to adjust between 24 inches and 36 inches, and any other length between 24 inches and 36 inches. This may be accomplished in a variety of methods including having sliders coupled to the cross bars 34 or the cross bars having two tubes, one disposed inside the other which are capable of moving with relation to each other. The pitched member 20 may also include a system of sliders and pivots to allow the adjustment between the various desired lengths depths for the firewood rack 10.

The various elements of the firewood rack 10 may be coupled together using a variety of methods and connectors. In one embodiment, the various elements may be coupled via a weld when metal is implemented. Other embodiments may include brackets and fasteners. In one embodiment, the vertical support members 15, top plate 26, and the ridge support member 22 all include receivers over which the corresponding parts may slide.

In one embodiment, the firewood rack 10 may include adjustable legs 40. The adjustable legs may be coupled to the lower end 19 of the vertical support members 15. The adjustable legs allow for the height of the firewood support member 30 and the firewood rack 10 generally to be adjusted vertically either up or down. The adjustable legs may include a variety of mechanical systems for actuating the adjustments including a telescoping legs with locking buttons, gears and motors, telescoping legs with clamps or legs with cotter pins, and any other embodiment readily available to one of skill in the art. The adjustable legs 40 may include base plates 42 coupled to a lower end of the adjustable legs 40. The base plates 42 may be a variety of shapes and size including bars, circular plates, square plates, and any other shape known to one of skill in the art which allows for the weight which the base plates 42 are supporting to be distributed over a larger surface area.

Firewood Rack Cover

Figure 8:
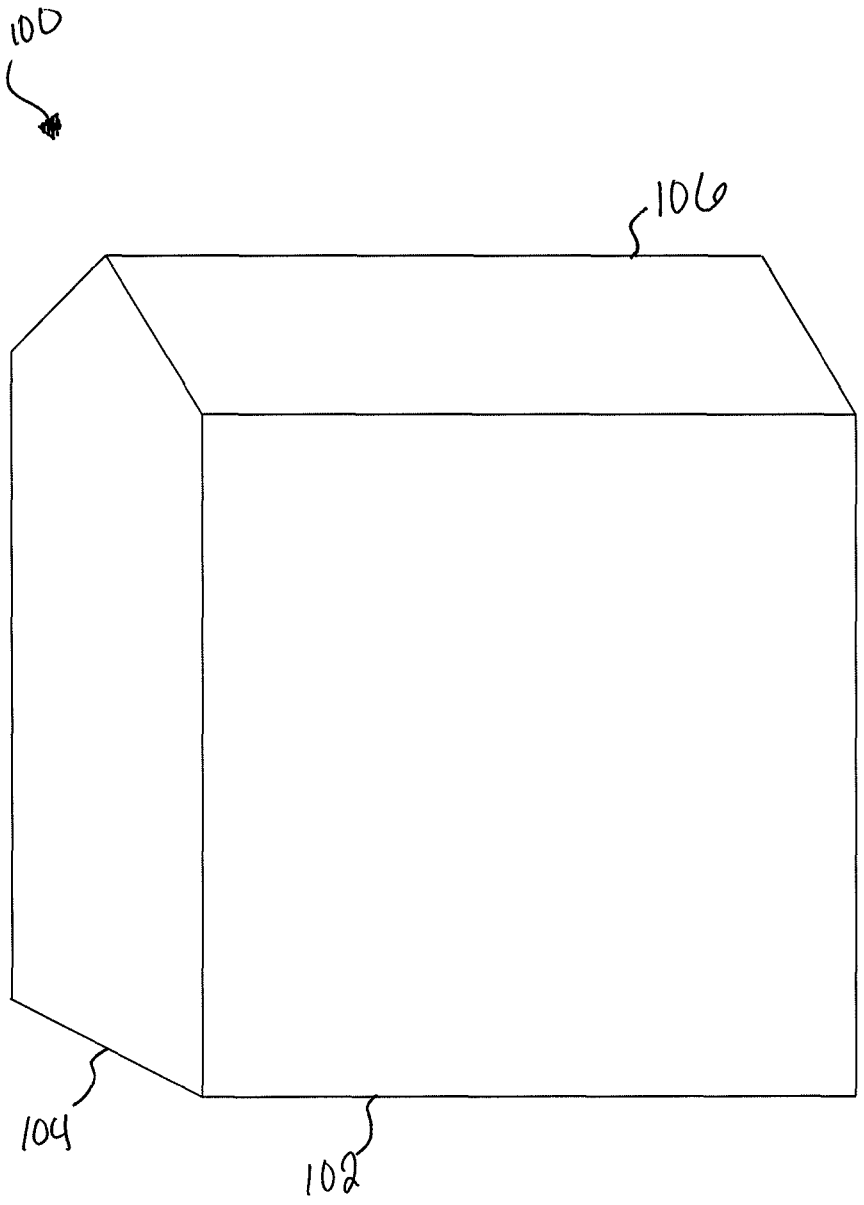
FIG. 8 is a perspective view of a firewood rack cover having a profile to match the gable profiled pitched member of a firewood rack.

Now referring to FIG. 8, a firewood rack cover 100 may be provided in connection with a firewood rack 10. The firewood rack cover 100 comprises a weatherproof material formed having at least two lengthwise panels 102 and at least two depth-wise panels 104. At least one more panel may be provided which is the pitched member panel 106. The lengthwise panels 102 and the depth-wise panels 104 may be alternating such that each lengthwise panel 102 is adjacent two depth-wise panels 104 and each depth-wise panel 104 is adjacent two lengthwise panels 102. The pitched member panel 106 may be adjacent to the lengthwise panels 102 and the depth-wise panels 104. The pitched member panel 106 may be shaped to match the profile of the pitched member 20. Thus, whether the pitched member 20 incorporates a gable profile a shack profile, a saltbox profile, or any other profile, the pitched member panel 106 will be fashioned such that it conforms with the pitched member profile.

In some embodiments the outer dimensions or profile of the firewood rack cover 100 and the profile firewood rack 10 match. In these embodiments, this allows for the firewood rack cover 100 to be placed radially outward from the firewood rack 10 and its contents. This allows for the weatherproof coating to repel inclement weather and moisture from the contents of the firewood rack 10.

In some embodiments, the firewood rack 10 is not fully enclosed by the firewood rack cover 100. The firewood rack cover 100 may be installed over the top of the firewood rack. Thus, the firewood rack cover 100 has on open end 108 which receives the firewood rack 10. As the firewood rack cover 100 is further advanced around the firewood rack 10, the firewood rack 10 and its contents are more thoroughly protected by the firewood rack cover 10.

Figure 9:
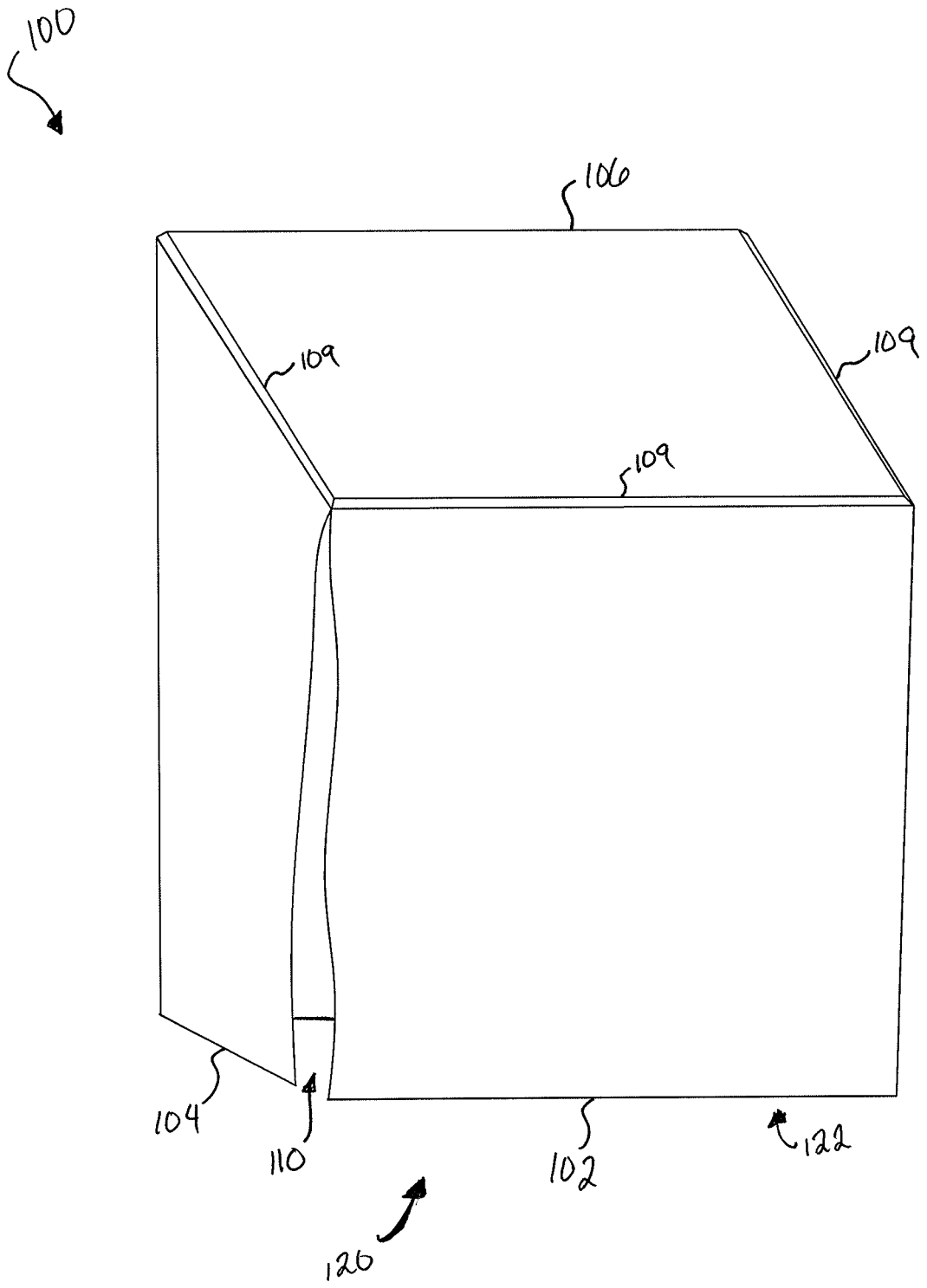
FIG. 9 is a perspective view of a firewood rack cover having a profile to match the shack profiled pitched member of a firewood rack, wherein the cover has a slit and extension panels.

As demonstrated in FIG. 9, the firewood rack cover 100 may include extension panels 109. The extension panels 109 may be coupled to or integrated into the material such that the firewood rack cover 100 may curve around the edges of the firewood rack 10. The extension panels 109 may be sewn in or may be a portion of the material formed into the appropriate shape.

Referring further to FIG. 9, the firewood rack 10 may be too tall to conveniently place the firewood rack cover 100 to protect the contents of the firewood rack 10 from the top. In some embodiments, the firewood rack cover 100 may include a slit 110 along in one of the lengthwise panels 102 or depth-wise panels 104, or between the lengthwise 102 and depth-wise 104 panels. Thus the firewood rack cover 100 may be pulled over and onto the firewood rack 10 with greater ease. When the firewood rack cover 100 is positioned appropriately on the firewood rack 10, the slit 110 may be sealed such that inclement weather and moisture may not escape through the slit 110 into the interior of the firewood rack cover 100. The slit 110 may be sealed via a number of mechanical fasteners, including zippers, hook and loop fasteners, ties, clips, adhesives, and any other fasteners to substantially seal the slit 110.

Figure 10:
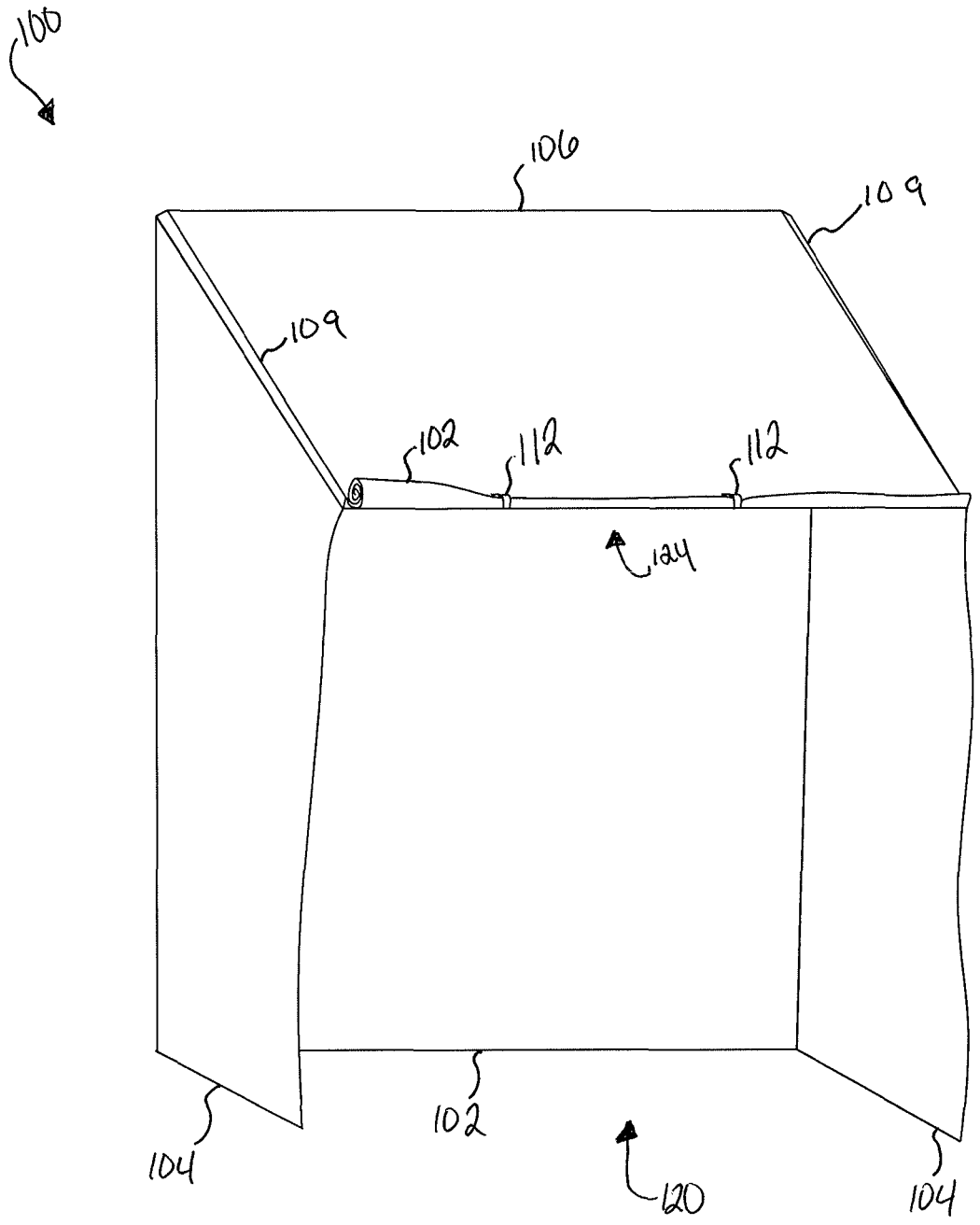
FIG. 10 is a perspective view of a firewood rack cover having a profile to match the shack profiled pitched member of a firewood rack, wherein the cover has a plurality of slits, extension panels, and fasteners to draw up a lengthwise panel.
Figure 11:
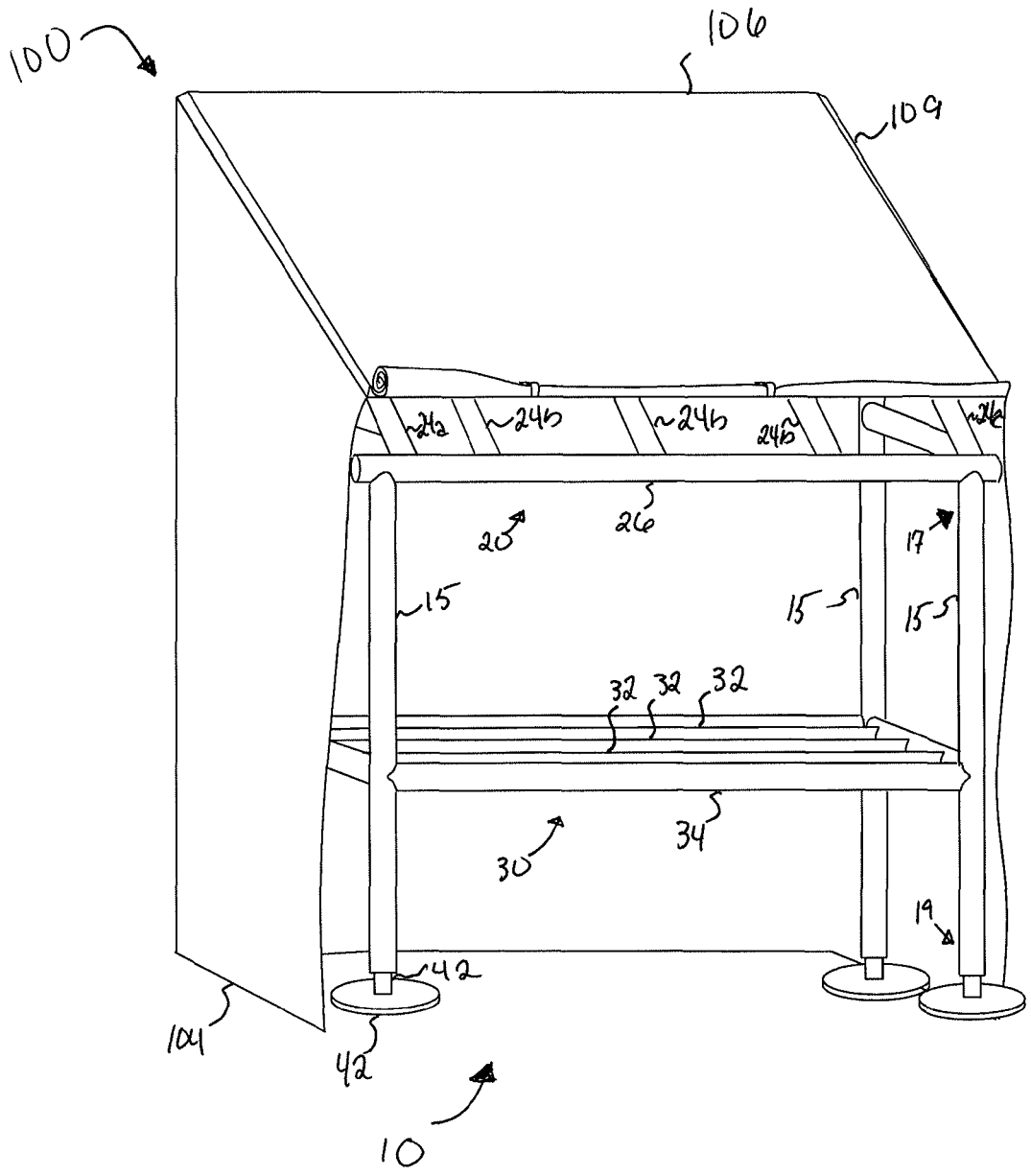
FIG. 11 is a perspective view of a firewood storage apparatus having a rack cover having a profile to match the shack profiled pitched member of a firewood rack, wherein the cover has a plurality of slits, extension panels, and fasteners to draw up a lengthwise panel and a firewood rack fitted in the inside of the firewood rack cover.

In another embodiment, as demonstrated in FIGS. 10 and 11, the firewood rack cover 100 may include a plurality of slits between multiple or all of the lengthwise panels 102 or depth-wise panels 104. The slit may run the height of each panel or a portion of the height of the panel such that the slit extends to or near the pitched member panel 106. The panels may include a system for fastening the panels by rolling the panels back to the length of the slits or pulling the panels to the side similar to drapes. For example, FIGS. 10 and 11 demonstrate an embodiment in which fasteners 112 are used to engage a rolled up lengthwise panel 102 for access to the contents. This allows for access to the materials stored on the firewood rack 10 while still offering protection to the materials. The panels may be easily replaced to their previous position for full protection of the materials on the firewood rack 10.

The firewood rack cover may incorporate a number of weatherproofing techniques including liners, sealers, weatherproof materials and any other method reasonably known to one of skill in the art.

Thus, although there have been described particular embodiments of the present invention of a new and useful FIREWOOD STORAGE CONTAINER AND COVER, it is not intended that such references be construed as limitations upon the scope of this invention.

What is claimed is:

1. A firewood storage apparatus, comprising: a firewood rack comprising:

a plurality of vertical support members, each vertical support member having an upper end and a lower end;

a pitched member having a pitched profile, having an upper surface and a lower surface, and supported by the plurality of vertical support members, wherein the upper ends of at least two vertical support members are coupled to the lower surface of the pitched member;

a firewood support member having a receiving surface for supporting firewood;

a plurality of adjustable legs, each adjustable leg coupled to the lower end of a vertical support member of the plurality of vertical support members; and a plurality of base plates coupled to the plurality of adjustable legs; and a firewood rack cover comprising:

at least one lengthwise panel;

at least one depth-wise panel;

a pitched member panel, an outer coating; and an inner cavity having an open end and a closed end, the inner cavity formed to receive the firewood rack, wherein the inner cavity closed end is pitched to facilitate the drainage of liquid from said firewood rack cover, the inner cavity closed end engages the pitched member, and an angle of the pitch of the inner cavity closed end matches an angle of the pitched profile of the pitched member, the at least one lengthwise panel and the at least one depth-wise panel couple to the pitched member panel, the pitched member panel is disposed at the inner cavity closed end, the at least one lengthwise panel and the at least one depth-wise panel extend from the pitched member panel toward the inner cavity open end, and each of the at least one lengthwise panel and the at least one depth-wise panel couple to the pitched member panel via an extension panel adapted to curve around an edge of the firewood rack.

2. The firewood storage apparatus of claim 1, wherein a first adjustable leg of the plurality of adjustable legs is longer than a second adjustable leg of the plurality of adjustable legs.

3. The firewood storage apparatus of claim 1, wherein the pitched member further comprises a plurality of rafters disposed on the lower surface of the pitched member.

4. The firewood storage apparatus of claim 1, wherein the firewood support member comprises a plurality of rails.

5. The firewood storage apparatus of claim 4, wherein the plurality of rails span a length of the firewood rack.

6. The firewood storage apparatus of claim 4, wherein the plurality of rails span a depth of the firewood rack.

7. The firewood storage apparatus of claim 1, wherein the firewood rack is adjustable to have a length between 24 inches and 36 inches.

8. The firewood storage apparatus of claim 1, wherein the firewood rack cover further comprises at least one slit disposed between the at least one lengthwise panel and the at least one depth-wise panel.

9. The firewood storage apparatus of claim 8, wherein the at least one slit extends from the inner cavity open end toward the inner cavity closed end.

10. The firewood storage apparatus of claim 1, wherein the at least one lengthwise panel and the at least one depth-wise panel are selectably sealable to each other.

11. The firewood storage apparatus of claim 1, wherein:

the at least one lengthwise panel includes two lengthwise panels;

the at least one depth-wise panel includes two depth-wise panels; and the lengthwise panels and the depth-wise panels are alternatingly coupled to the pitched member panel.

12. The firewood storage apparatus of claim 1, wherein the firewood rack cover further comprises a fastener adapted to engage with the at least one lengthwise panel and hold the at least one lengthwise panel in a rolled position.

13. A firewood storage apparatus, comprising: a firewood rack, comprising:

a pitched member having a pitched profile;

a plurality of vertical support members, wherein an upper end of each vertical support member is disposed on a lower surface of the pitched member;

a firewood support member disposed beneath the pitched member, the firewood support member including a receiving surface for supporting firewood; a firewood rack cover, comprising:

a pitched member panel; and a plurality of side panels coupled to the pitched member panel and extending away from the pitched member panel, wherein the plurality of side panels includes at least one lengthwise panel and at least one depth-wise panel, wherein the pitched member is disposed at an inner cavity closed end formed by the coupling of the plurality of side panels to the pitched member panel, the inner cavity closed end engages the pitched member, and an angle of the pitch of the inner cavity closed end matches an angle of the pitched profile of the pitched member, the at least one lengthwise panel and the at least one depth-wise panel extend from the pitched member panel toward an inner cavity open end, and each of the at least one lengthwise panel and the at least one depth-wise panel couple to the pitched member panel via an extension panel adapted to curve around an edge of the firewood rack.

14. The firewood storage apparatus of claim 13, further comprising at least one slit disposed between at least two side panels of the plurality of side panels.

15. The firewood storage apparatus of claim 14, wherein the firewood rack cover further comprises at least one fastener adapted to selectably seal the at least two side panels to each other.

16. The firewood storage apparatus of claim 13, wherein:

the at least one lengthwise panel includes two lengthwise panels;

the at least one depth-wise panel includes two depth-wise panels; and the lengthwise panels and the depth-wise panels are alternatingly coupled to the pitched member panel.

17. The firewood storage apparatus of claim 13, wherein the pitched member further comprises a plurality of rafters disposed on the lower surface of the pitched member.

18. The firewood storage apparatus of claim 13, wherein the firewood support member comprises a plurality of rails.

19. The firewood storage apparatus of claim 18, wherein the plurality of rails span a length of the firewood rack.

20. The firewood storage apparatus of claim 18, wherein the plurality of rails span a depth of the firewood rack.

* * * * *